US005349728A

United States Patent [19]

Murakami et al.

[11] Patent Number: 5,349,728

[45] Date of Patent: Sep. 27, 1994

[54] MAGNETIC POSITION MARKER AND CONTROL SYSTEM FOR PRODUCTION OF FELT

[75] Inventors: Fumio Murakami; Eiichi Morita, both of Saitama; Tokuji Iwasaki, Chiba; Yasushi Suzuki, Tokyo; Kouha Fujimoto, Osaka, all of Japan

[73] Assignee: Nippon Felt Co., Ltd., Japan

[21] Appl. No.: 889,840

[22] Filed: May 27, 1992

[51] Int. Cl.[5] ..... D04H 17/00; G08B 13/24

[52] U.S. Cl. ..... 28/107; 28/110; 340/551

[58] Field of Search ..... 28/107, 110; 112/262.1; 428/195, 900; 340/551

[56] References Cited

U.S. PATENT DOCUMENTS

| | | | |
|---|---|---|---|
| 3,773,004 | 11/1973 | Ioannilli et al. | 112/262.1 |
| 4,185,989 | 1/1980 | Tooth | 429/195 |
| 4,614,969 | 9/1986 | Gerundt et al. | 28/110 X |
| 4,758,788 | 7/1988 | Weiss et al. | 340/551 X |
| 4,785,750 | 11/1988 | Best | 112/262.1 |
| 4,960,651 | 10/1990 | Pettigren et al. | 428/900 X |
| 4,962,576 | 10/1990 | Mimischofer et al. | 28/110 |
| 5,001,331 | 3/1991 | Leestemaker | 235/375 |
| 5,015,993 | 5/1991 | Strom-Olsen et al. | 340/551 |
| 5,175,419 | 12/1992 | Yamashita | 340/551 X |
| 5,204,526 | 4/1993 | Yamashita et al. | 340/551 X |

FOREIGN PATENT DOCUMENTS 3619070 1/1987 Fed. Rep. of Germany ..... 28/110

*Primary Examiner*—Clifford D. Crowder
*Assistant Examiner*—John J. Calvert
*Attorney, Agent, or Firm*—Marshall & Melhorn

[57] ABSTRACT

A magnetic marker comprising a plurality of magnetized fibers oriented substantially parallel to each other is attached to a fringe of ground fabric for production of felt in the form of an endless belt for detecting the travel of the ground fabric and changing various production parameters according to the number of turns which the ground fabric makes around a series of rolls for causing the movement of the ground fabric. Since the magnetic marker consists of extremely thin magnetized fibers, it can withstand the repeated piercing by needles which is required for the production of felt for the purpose of entangling the fibers of fiber web with the ground fabric.

10 Claims, 4 Drawing Sheets

MAGNETIC POSITION MARKER AND CONTROL SYSTEM FOR PRODUCTION OF FELT

TECHNICAL FIELD

The present invention relates to a magnetic position marker and a position detecting device suitable for use in controlling the process of producing press felt intended for use in paper making machines. The production of press felt involves the process of entangling fibers of fiber web consisting of layers of woollen or synthetic fibers with the ground fabric by needling. The control process for such a production process typically involves adjustment of the needling stroke, the density of needling, the feeding speed of the ground fabric, and the tension of the ground fabric during the process of needling.

BACKGROUND OF THE INVENTION

In a paper making machine, water is removed from a wet web of paper fibers between a series of mutually opposing rolls by compressing the paper fiber web, and press felt in the form of an endless belt having a relatively large width is wrapped around such rollers. The press felt is fabricated by passing woven ground fabric in the form of an endless belt around rolls including a motor driven roll and guide rolls, and entangling fibers of fiber web consisting of layers of woollen or synthetic fiber web with the ground fabric by needling as the ground fabric is passed under a needle head along with the fiber web placed thereon.

During the process of needling, for the fibers to be favorably entangled with the ground fabric, it is necessary to adjust the stroke of needling, the density of needling and the feed speed of the ground fabric according to the number of turns which the ground fabric has made around the feed and guide rolls. Since the press felt must be highly smooth along the circumferential direction thereof without any steps or local irregularities, it is difficult to determine how many turns the press felt has made at any particular given time. Furthermore, since the time point of adjustment must coincide with the point of transition from one layer of fiber web to another, the detection of the rotation of the drive roll would not allow a sufficiently accurate detection of the position of the press felt during the process of needling.

Conventionally, the operator placed a red thread or made a red mark with dye or ink in the ground fabric to identify a reference point on the press felt, and manually made necessary adjustments by visually determining the number of turns the ground fabric had made. Therefore, the operator was required to count the number of turns the press web had made and quickly make necessary adjustments upon detection of such a marker. This required a high level of concentration, and the quality of the press felt was highly dependent on the quality of the operator. Therefore, there has been a strong demand to automate the process of felt fabrication by needling.

For automating the process of needling, it is preferable to be able to use a marker which can be easily detected with a sensor. However, conventionally known markers were inadequate because they tended to be quickly damaged by the process of needling in which the entire press felt including the sensor is repeatedly pierced by needles, and were rendered useless in a very short time.

BRIEF SUMMARY OF THE INVENTION

In view of such problems of the prior art, a primary object of the present invention is to provide a marker for an object such as an endless belt of such material as press felt which is suitable for detection with a sensor and can retain its function as a marker even after being repeatedly pierced by needles.

A second object of the present invention is to provide a control system including position detecting means suitable for use in apparatus for fabricating press felt intended for use in paper making machines.

These and other objects of the present invention can be accomplished by providing a magnetic marker, comprising: a base sheet; and a plurality of magnetized fibers, preferably, consisting of amorphous metal or alloy attached by suitable means, such as an adhesive layer, to a surface of the base sheet, preferably, the magnetized fibers being oriented substantially parallel to each other.

By attaching such a magnetic marker to a lateral fringe of ground fabric for production of felt in the form of an endless belt for detecting the travel of the ground fabric, it becomes possible to change various production parameters according to the number of turns which the ground fabric makes around a series of rolls for causing the movement of the ground fabric. Since the magnetic marker consists of extremely thin magnetized fibers, it can withstand the repeated piercing by needles which is required for the production of felt for the purpose of entangling the fibers of fiber web with the ground fabric. Further, the use of amorphous metal or alloy allows generation of a high level of magnetic flux even when the diameter of the magnetic fibers is extremely small.

BRIEF DESCRIPTION OF THE DRAWINGS

Now the present invention is described in the following with reference to the appended drawings, in which.

DETAILED DESCRIPTION OF THE PREFERRED EMBODIMENT

Figure 1:
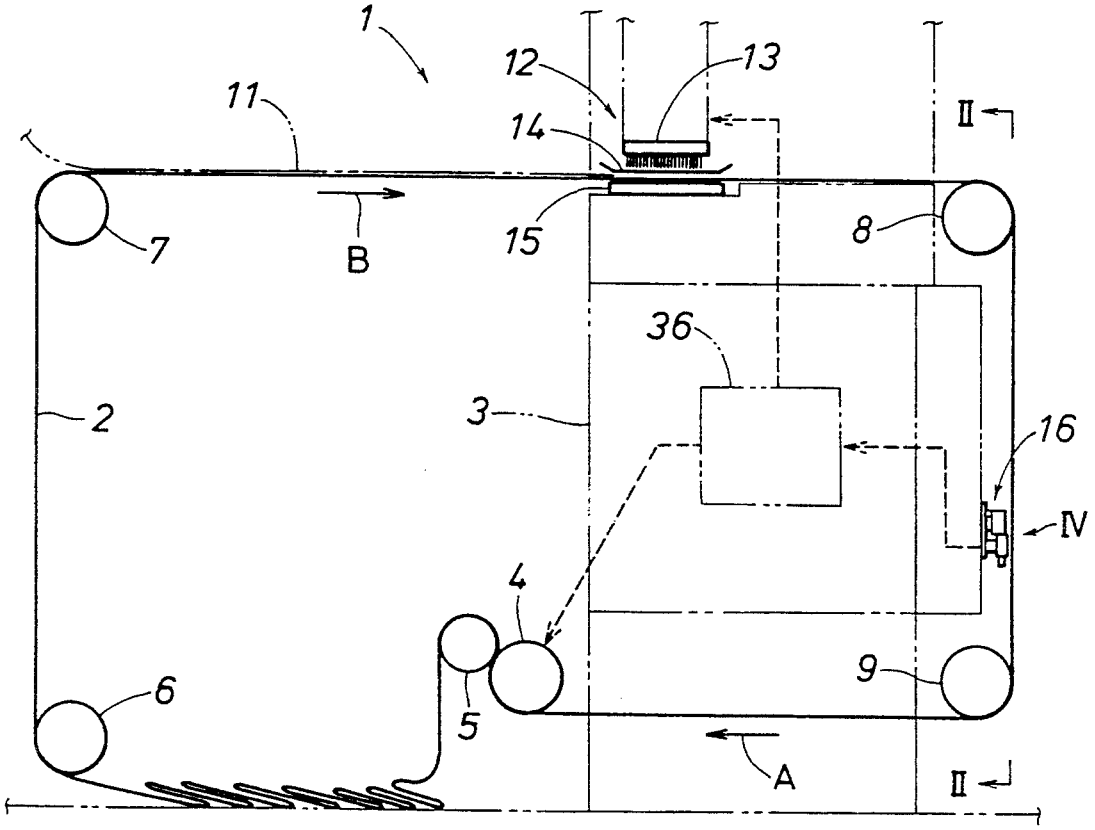
FIG. 1 is a schematic view illustrating the overall structure of apparatus for fabricating press felt incorporating an embodiment of the magnetic marker according to the present invention.
Figure 2:
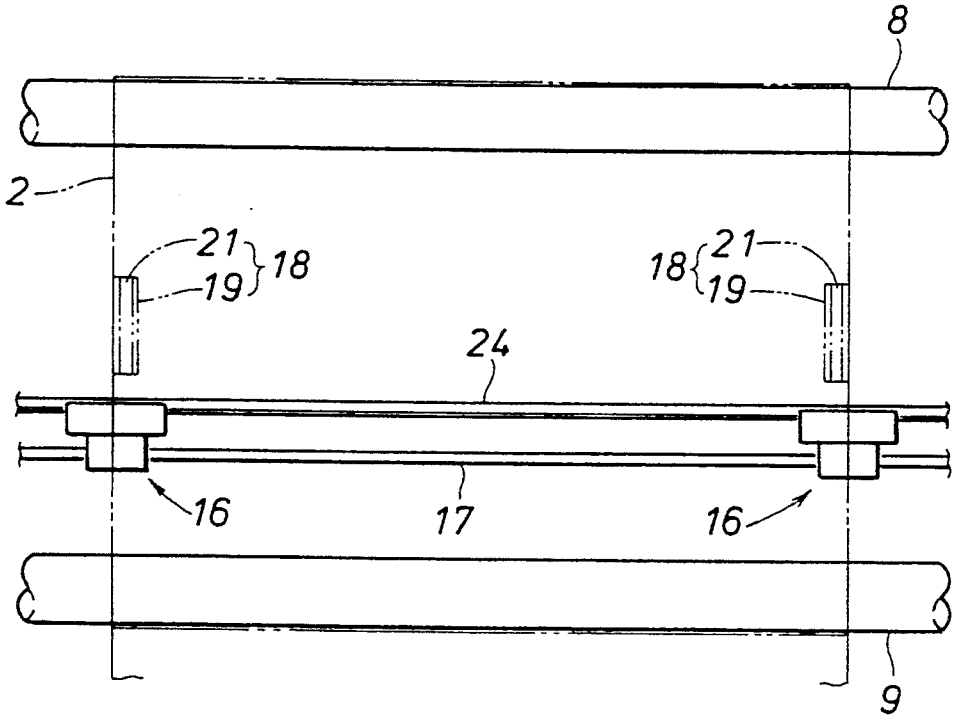
FIG. 2 is a sectional side view taken along line II—II of FIG. 1.

FIGS. 1 and 2 generally show a press felt fabricating device 1 according to the present invention. The press felt which is produced by this device 1 is used for removing water from wet paper in a paper making machine.

Ground fabric 2 consisting of an endless belt of woven fabric having a relatively large width is passed around a plurality of rolls in a main body of a needle machine 3 so as to travel around them in clockwise direction as illustrated in FIG. 1. More specifically, the ground fabric 2 is fed in the direction indicated by arrow A in FIG. 1 by being held between a drive roll 4 and a touch roll 5, and, after being fed out of the touch roll 5 and stored in a lower part of the device 1, is guided upward by a guide roll 6 to a brake roll 7 which, located above the guide roll 6, deflects the ground fabric 2 into a horizontal path extending between the brake roll 7 and a delivery roll 8 provided in an upper right part of the needle machine main body 3. The ground fabric 2 is fed along this horizontal path in the direction indicated by arrow B in FIG. 1, and, after being deflected downward by the delivery roll 8, is deflected horizontally toward the drive roll 4 by a guide roll 9 located under the delivery roll 8. In this way, the ground fabric 2 forms a complete loop which is passed around the rolls 4 through 9.

Layers of fiber web 11 are individually placed over the upper surface of the ground fabric 2 near the brake roll 7, and are each conveyed jointly with the ground fabric 2 as it is conveyed between the brake roll 7 and the delivery roll 8. The fiber web 11 is prepared from wool or synthetic fibers by a card machine not shown in the drawing, and is typically folded over into several layers before it is placed over the ground fabric 2 as a single fiber web.

An upper part of the main body of the needle machine 3 is provided with a needle punch unit 12 for entangling the fibers of the fiber web 11 with the ground fabric 2. This needle punch unit 12 is of a known structure, and comprises a needle head 13 having, on its lower surface, a multiplicity of needles arranged in a dense staggered arrangement and directed toward the upper surface of the ground fabric 2, a stripper plate 14 interposed between the needle head 13 and the ground fabric 2 and provided with a multiplicity of through holes corresponding to the needles of the needle head 13, and a bed plate 15 guiding the lower surface of the ground fabric 2 and provided with holes similar to the holes of the stripper plate 14.

A pair of sensor blocks 16 are provided each adjacent to either fringe of the ground fabric 3 as it is conveyed downward between the delivery roll 8 and the guide roll 9 along a vertical path. As illustrated in FIG. 2, each of the sensor blocks 16 is guided by a guide rail 17 fixedly secured to one side of the main body of the needle machine 3 so as to be moveable in a lengthwise direction or in a direction perpendicular to the feeding direction of the ground fabric 2 along the reverse surface of the ground fabric 2.

Figure 3:
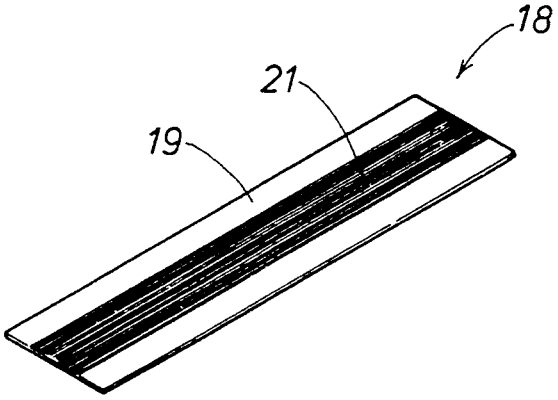
FIG. 3 is a perspective view showing a magnetic marker according to the present invention.

According to the present embodiment, a marker 18 is secured to a lateral fringe part of the ground fabric 2 for detecting the movement of the ground fabric 2, and another similar marker is secured to an opposite fringe part of the ground fabric 2 so that the two markers 18 may be substantially aligned with each other in the lateral direction. As illustrated in FIG. 3, each of the markers 18 comprises a base sheet 19 consisting of a strip of fabric tape carrying an adhesive layer on each face thereof, and a plurality of magnetized fibers which may consist of amorphous magnetic metal or alloy each approximately 30 micro meters in diameter and arranged parallel to each other. The magnetized fibers may consist of the amorphous metallic fibers sold under the tradename of Sency by Unitika KK of Tokyo, Japan. This structure allows easy handling of extremely thin metallic fibers.

More specifically, according to this embodiment, the adhesive layer on one side of the base sheet 19 firmly secures the metallic fibers 21. By magnetically detecting the presence of the metallic fibers 21, it is possible to detect the position or the movement of the ground fabric 2.

Figure 4:
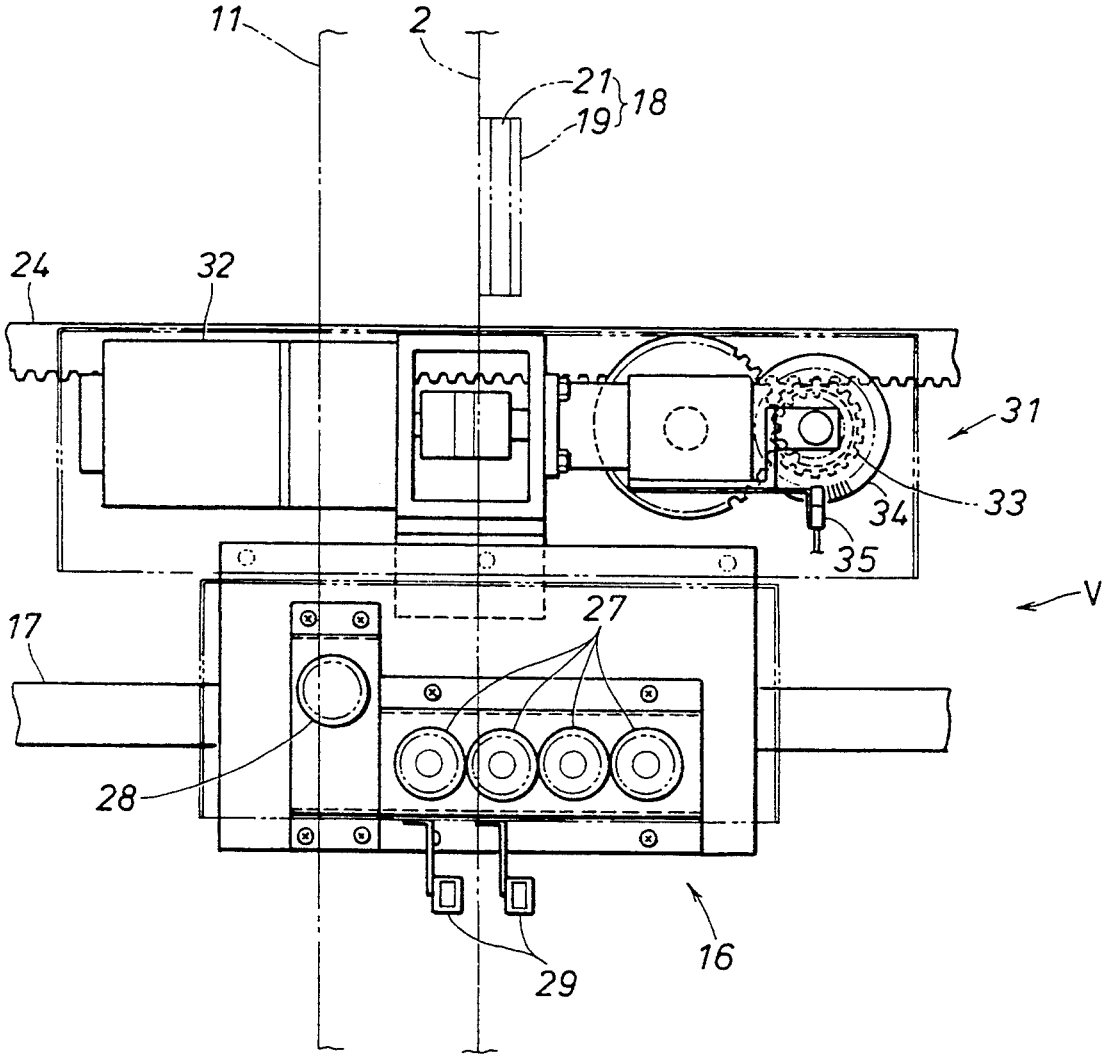
FIG. 4 is an enlarged front view of the sensor block as seen in the direction indicated by arrow IV in FIG. 1.
Figure 5:
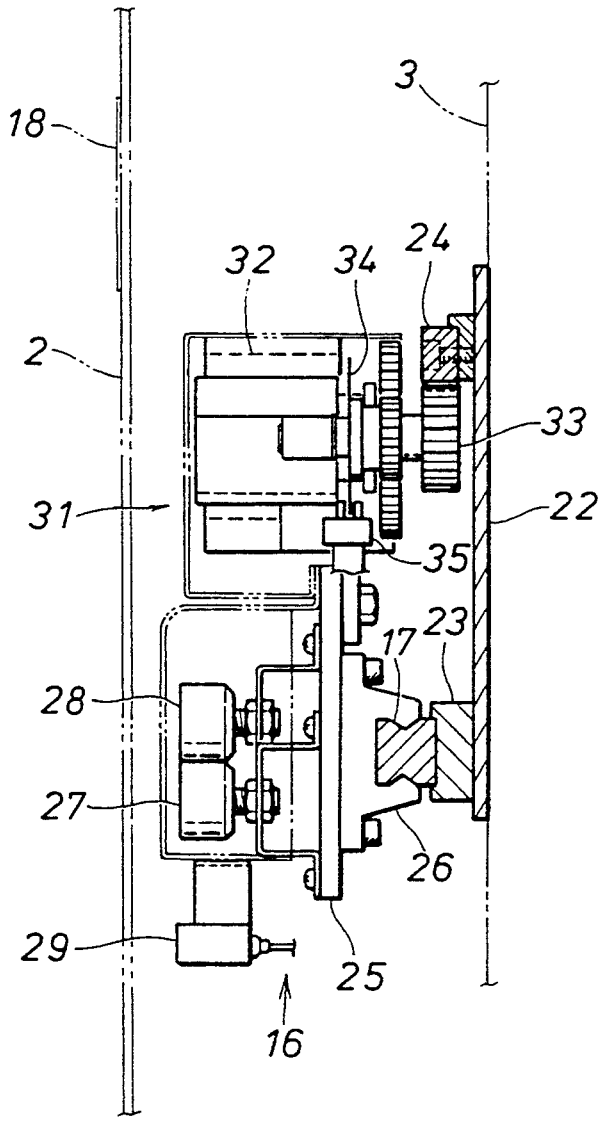
FIG. 5 is a side view as seen in the direction indicated by arrow V in FIG. 4.

Referring to FIG. 5, the guide rail 17 is fixedly secured, via mounting block 23, to a support plate 22 fixedly secured to the side portion of the main body of the needle machine 3 as mentioned earlier, and a rack 24 is fixedly secured to the support plate 22 parallel to and vertically spaced apart from the guide rail 17. A slider 26 which is guided by the guide rail 17 is provided with a sensor mounting plate 25 for integrally carrying the sensor block 16, and the sensor mounting plate 25 carries magnetic sensors 27 for magnetically detecting the marker 18. As illustrated in FIG. 4, there are four such magnetic sensors 27 arranged in a row extending perpendicularly to the feed direction of the ground fabric 2 on each lateral side thereof. A part of the sensor mounting plate 25 corresponding to the outer edge of the ground fabric 2 is provided with a proximity sensor 28 for measuring the width of the ground fabric 2, and a pair of photoelectric sensors 29 are arranged under the proximity switch 28 and the magnetic sensors 27 for the tracking control of the sensor block 16 by photoelectrically detecting the edge of the ground fabric 2.

The upper end of the sensor mounting plate 25 is integrally connected to a motor unit 31 incorporating a motor 32. The output shaft of the motor 32 is connected to a pinion gear 33 via reduction gear unit, and the pinion gear 33 in turn meshes with the rack 24 which is fixedly secured to the mounting plate 22. Therefore, by driving the motor 32 in either direction, the sensor block 16 can be moved in a desired direction along the guide rail 17. The pinion gear 33 is coaxially connected to a slit disk 34 so that the travel of the sensor block 16 can be measured by photoelectrically counting radial slits provided in the slit disk 34 with a photoelectric rotation sensor 35. The sensors 27 through 29, the motor 32 and the rotation sensor 35 are electrically connected to a control unit 36 (FIG. 1) which controls the operation of the drive means for the needle punch unit 12 and the drive roll 4, and the brake torque of the brake roll 7 for applying an appropriate tension to the ground fabric 2.

Now the operation of the above described apparatus for fabricating press felt is described in the following.

First of all, ground fabric 2 in the form of an endless belt is passed around the rolls 4 through 9, and a pair of markers 18 are attached to reference points on the side fringes of the ground fabric 2. The ground fabric 2 is then driven in the direction indicated by arrow A in FIG. 1 with the drive roll 4 so that the needling of fiber web 11 into the ground fabric 2 may be carried out over the entire area of the ground fabric 2. Prior to this needling process, the sensor blocks 16 are positioned at their respective initial positions located on either side end of the main body of the needle machine 3.

After the ground fabric 2 has started moving, either automatically or by manually operating a start switch of each sensor block 16 not shown in the drawings, each of the sensor blocks 16 is moved toward the corresponding edge of the ground fabric 2, and is thereafter made to follow the edge of the ground fabric 2 even in the presence of the lateral wiggling of the ground fabric owing to the tracking control of the sensor block 16 by the photoelectric sensors 29. Therefore, every time the ground fabric 2 makes a full turn around the series of rolls 4 through 9, the marker 18 passes near the corresponding magnetic sensors 27, and the reference point of the ground fabric 2 can be detected in a reliable fashion. Every time the magnetic sensors 27 have detected the marker 18 or every time the ground fabric has made a full turn, the sensor block 16 is moved inwardly so that the proximity sensor 28 may detect the edge of the ground fabric 2, and measure the width of the ground fabric 2 for the convenience of the evaluation of the quality of the press felt that is going to be produced.

The fiber web 11 is integrally joined with the ground fabric 2 as the needles of the needle punch unit 12 are repeated pierced through the fiber web 11 and the ground fabric 2, and the fibers of the fiber web 11 get entangled with the ground fabric 2. Upon completion of the needling of the first layers of fiber web 11, second layers of fiber web 11 are placed thereon, and are likewise subjected to a similar needling process. This process is repeated 4 to 7 times before the final press felt is produced.

During the process of needling, it is necessary to adjust the needling stroke and the needling density by the needle punch unit 12 according to the number of turns the ground fabric 2 has made and the different layers of the fiber web. According to the present invention, the number of turns the ground fabric 2 has made can be automatically detected by detecting the markers 18 with the magnetic sensors 27. The signals detected by the magnetic sensors 27 are supplied to the control unit 36 so that the drive means for the needle punch unit 12 and the drive roll 4 and the brake means for the brake roll 7 can be automatically controlled to optimum levels for each different turn which the ground fabric makes.

Since the markers of the present embodiment consist of a plurality of extremely fine metallic fibers arranged in a mutually parallel relationship, the needles of the needle punch unit would not encounter any obstacle as they are pierced through the ground fabric, and, therefore, would not be damaged by the markers even after a long use. Further, since the metallic fibers of the markers 18 would also not be damaged or dispersed by the needles, they retain their capability as markers at all times. Since the markers are magnetically detected, the markers may be detected even when the ground fabric is reversed for needling from the reverse surface of the ground fabric. Upon completion of the needling process, since the markers 18 are integrally combined with the completed press felt without any unevenness, the produced press felt containing the markers combined therewith can be used for the production of paper without creating any problem. If desired, the markers 18 may be removed from the produced press felt when trimming the lateral fringe of the ground fabric upon completion of the process of needling.

According to the present invention, since the monitoring of the movement of the ground fabric during the process of needling can be carried out without involving any human intervention, it is possible to automate the process of needling and select various parameters at optimum values for each different stage of the needling process. Therefore, the present invention allows reduction in the cost of press felt production through reduction in the need for human attendance on the one hand, and improvement in the quality of the produced press felt through optimum and accurate selection of various parameters of needling on the other hand.

Although the present invention has been described in terms of a specific embodiment, it is possible to modify and alter details thereof without departing from the spirit of the present invention. For instance, the markers and the system for detecting the markers are useful not only in the production of press felt, but also in other production processes where detection of the position of an object is required.

What we claim is:

1. A control system for production of felt by needling, comprising:

powered conveying means for conveying ground fabric for said felt in a lengthwise direction of said felt;

needle punch unit for integrally entangling fibers of a fiber web with said ground fabric by repeatedly piercing an assembly of said ground fabric and said fiber web with a plurality of punch needles;

a pair of magnetic markers are secured in lateral alignment to opposite fringe parts of said ground fabric, said magnetic markers including a base sheet and a plurality of magnetized fibers attached to a surface of said base sheet and arranged in a parallel relationship to accommodate the repeated piercing of said markers by the plurality of punch needles;

magnetic sensor means secured to a part of said system for detecting said markers; and control means for selecting operation parameters of said needle punch unit and said powered conveying means according to a travel of said magnetic markers on said ground fabric as detected by said magnetic sensor means.

2. A control system according to claim 1, wherein said ground fabric is in the form of an endless belt.

3. A control system according to claim 2, wherein said magnetic marker is secured to a fringe part of said ground fabric.

4. A control system according to claim 1, wherein said magnetized fibers consist of amorphous metal or alloy.

5. A control system according to claim 1, wherein said magnetized fibers are attached to said base sheet by an adhesive layer provided on the surface of said base sheet.

6. A control system according to claim 5, wherein a surface of the base sheet opposite the magnetized fibers is provided with an adhesive layer for attaching said magnetic marker to the ground fabric.

7. A control system for production of felt by needling, comprising:

powered conveying means for conveying an endless belt of ground fabric for said felt in a lengthwise direction of said felt;

needle punch unit for integrally entangling fibers of a fiber web with said ground fabric by repeatedly piercing an assembly of said ground fabric and said fiber web with a plurality of punch needles;

a pair of laterally aligned magnetic markers secured to opposite fringe parts of said ground fabric, said magnetic marker including a base sheet and a plurality of magnetized fibers attached to a surface of said base sheet and arranged in a parallel relationship to accommodate the repeated piercing of said markers by the plurality of punch needles;

magnetic sensor means, including a plurality of sensors arranged in a row extending substantially perpendicular to said lengthwise direction, said sensor means being secured to a fixed part of said system for detecting said markers; and control means for selecting operation parameters of said needle punch unit and said powered conveying means according to a travel of said magnetic markers on said ground fabric as detected by said magnetic sensor means.

8. A control system according to claim 1, further comprising edge detection means for detecting a lateral edge of said ground fabric.

9. A control system according to claim 8, wherein said edge detection means and said magnetic sensor means are mounted on a carriage which can be moved in a direction substantially perpendicular to said lengthwise direction, and an output of said edge detection means is used for tracking control of said magnetic sensor means with respect to said magnetic marker.

10. A control system according to claim 8, wherein said edge detection means is mounted on a carriage which can be moved in a direction substantially perpendicular to said lengthwise direction at each lateral side position adjacent an edge of said ground fabric, and an output of each of said edge detection means is used for measuring a width of said ground fabric.

* * * * *